US010747155B2

(12) United States Patent
Uehara et al.

(10) Patent No.: US 10,747,155 B2
(45) Date of Patent: Aug. 18, 2020

(54) FIXING DEVICE AND IMAGE FORMING APPARATUS

(71) Applicant: KYOCERA Document Solutions Inc., Osaka (JP)

(72) Inventors: Masakazu Uehara, Osaka (JP); Hironori Takahashi, Osaka (JP); Tomohiro Watatani, Osaka (JP); Yuhiro Sakai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/712,175

(22) Filed: Dec. 12, 2019

(65) Prior Publication Data

US 2020/0201219 A1 Jun. 25, 2020

(30) Foreign Application Priority Data

Dec. 21, 2018 (JP) ..... 2018-239762

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
See application file for complete search history.

(56) References Cited

U.S. PATENT DOCUMENTS

2002/0118978 A1* 8/2002 Nakamura ..... G03G 15/2042 399/69
2005/0141932 A1* 6/2005 Sugiyama ..... G03G 15/2064 399/328
2006/0257180 A1* 11/2006 Nakagawa ..... G03G 15/206 399/329

FOREIGN PATENT DOCUMENTS

JP 2017097143 A 6/2017

* cited by examiner

*Primary Examiner* — Gregory H Curran
(74) *Attorney, Agent, or Firm* — Studebaker & Brackett PC

(57) ABSTRACT

In a fixing device, a heating section is disposed opposite to an inner circumferential surface of a fixing belt, and includes a heater, a heater holding member, a reinforcing member extending in a rotation axis of the pressure member, a heat sensitive body disposed on the heater holding member, and an urging member disposed between the reinforcing member and the heat sensitive body. The heater holding member includes an engaging portion engaging with a first end of the reinforcing member. In a state in which the reinforcing member is located opposite to the heater holding member through the reinforcing member turning about the engaging portion as a pivot, the urging member urges the heat sensitive body against the heater and a distance between the heat sensitive body and a second end of the reinforcing member is shorter than a distance between the heat sensitive body and the first end.

10 Claims, 9 Drawing Sheets

FIXING DEVICE AND IMAGE FORMING APPARATUS

INCORPORATION BY REFERENCE

The present application claims priority under 35 U.S.C. § 119 to Japanese Patent Application No. 2018-239762, filed on Dec. 21, 2018. The contents of this application are incorporated herein by reference in their entirety.

BACKGROUND

The present disclosure relates to a fixing device and an image forming apparatus.

Fixing devices using a heating film have been known to be included in electrographic image forming apparatuses. A fixing device such as above includes a fixing assembly and a pressure roller that presses against the fixing assembly to form a fixing nip part. The fixing assembly includes a tubular fixing film, a heater in contact with an inner surface of the fixing film, a heat insulating holder that holds the heater, a metal stay that presses the heat insulating holder against the pressure roller, a thermistor, and a thermal conduction member. The thermistor is provided on the heat insulating holder and in contact with the thermal conduction member at a specific pressure through a through hole in the heat insulating holder. The thermal conduction member is held by the heat insulating holder between the heater and the heat insulating holder.

Each of the heater, the heat insulating holder, the metal stay, and the thermal conduction member extends in a direction perpendicular to a recording medium conveyance direction. In a state in which the metal stay is attached to the heat insulating holder, the load of the metal stay is transmitted to the heat insulating holder in a longitudinal direction of the heat insulating holder via pressure springs disposed at opposite ends of the metal stay in the longitudinal direction of the metal stay. Heat accumulated in a paper non-passing area of the fixing nip part is transmitted to the thermistor via the thermal conduction member. In the fixing device, an excessive increase in temperature of the paper non-passing area can be suppressed.

SUMMARY

A fixing device according to an aspect of the present disclosure includes a fixing belt, a pressure member, and a heating section. The pressure member applies pressure to the fixing belt while in contact with an outer circumferential surface of the fixing belt and rotates about a rotation axial line of the pressure member. The heating section is disposed opposite to an inner circumferential surface of the fixing belt. The heating section includes: a heater that heats the fixing belt; a heater holding member that holds the heater; a reinforcing member that extends in a direction parallel to the rotation axis of the pressure member and that reinforces the heater holding member; a heat sensitive body that is disposed on the heater holding member so as to be located opposite to the heater; and an urging member disposed between the reinforcing member and the heat sensitive body. The reinforcing member has a first end and a second end that are two opposite ends in a longitudinal direction of the reinforcing member. The heater holding member includes an engaging portion engaging with the first end of the reinforcing member. The reinforcing member turns about the engaging portion as a pivot to be opposite to the heater holding member. The urging member urges the heat sensitive body against the heater in a state in which the reinforcing member is located opposite to the heater holding member. In the state in which the reinforcing member is located opposite to the heater holding member, a distance between the heat sensitive body and the second end of the reinforcing member is shorter than a distance between the heat sensitive body and the first end of the reinforcing member.

According to another aspect of the present disclosure, an image forming apparatus includes the above-described fixing device and an image forming section. The image forming section forms a toner image on a sheet. The fixing device fixes the toner image to the sheet.

DETAILED DESCRIPTION

Figure 1:
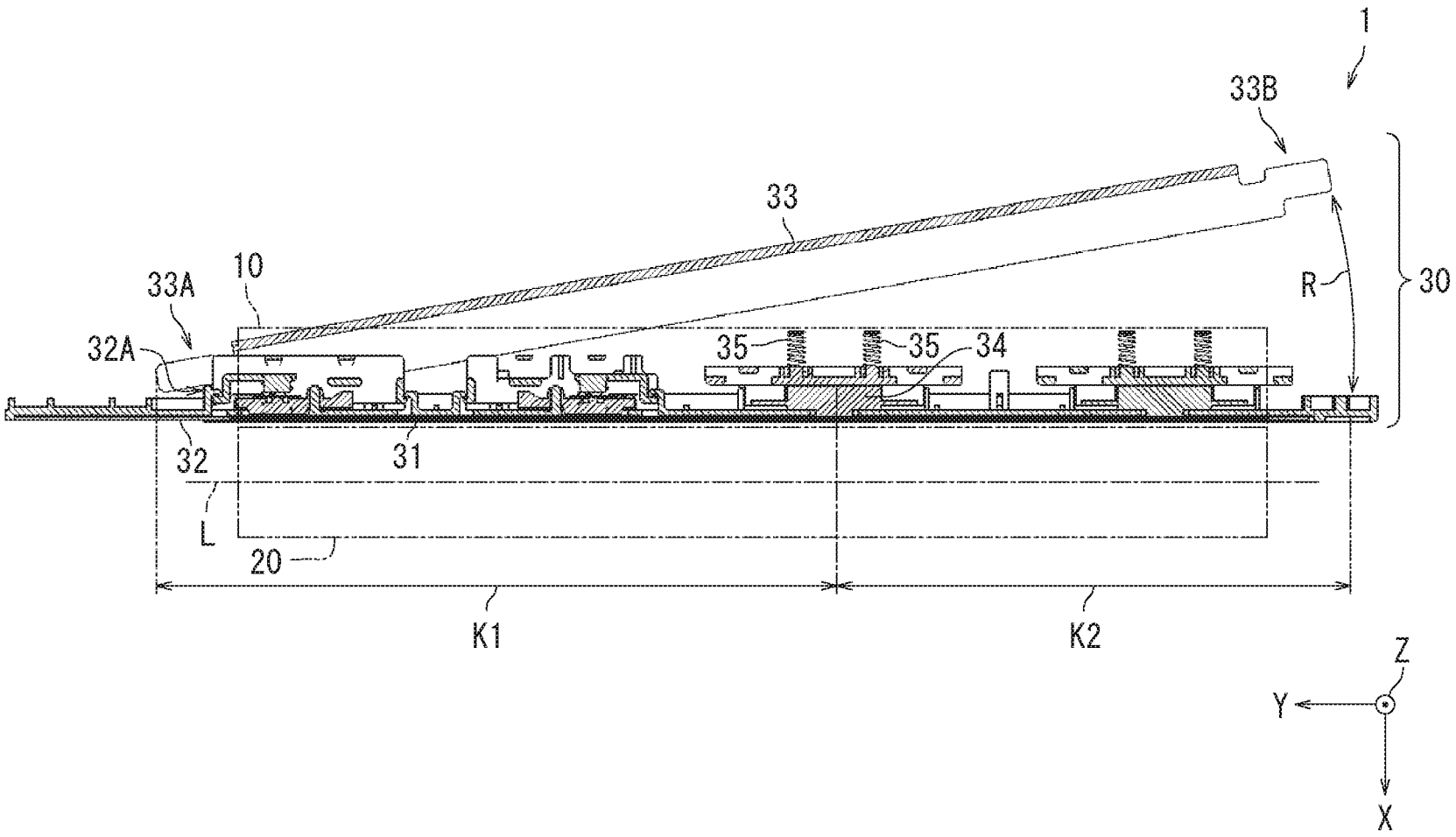
FIG. 1 is a cross-sectional view of a fixing device according to an embodiment of the present disclosure.

The following describes embodiments of the present disclosure with reference to the accompanying drawings. Elements that are the same or equivalent are indicated by the same reference signs in the drawings, and description thereof is not repeated. In a three-dimensional rectangular coordinate system in the following embodiments, an X axis and a Y axis are parallel to a horizontal plane and a Z axis is parallel to a vertical direction. A direction of the Y axis is an example of a direction of a "rotation axis" of a "pressure member" in the present disclosure.

An embodiment of a fixing device 1 according to the present disclosure will be described with reference to FIG. 1. FIG. 1 is a cross-sectional view of the fixing device 1. As illustrated in FIG. 1, the fixing device 1 includes a fixing belt 10, a pressure member 20, and a heating section 30. The fixing device 1 is included for example in an electrographic image forming apparatus.

The fixing belt 10 is an endless belt. The pressure member 20 applies pressure to the fixing belt 10 while in contact with an outer circumferential surface of the fixing belt 10, and rotates about a rotation axis L of the pressure member 20. The pressure member 20 is for example a pressure roller.

The heating section 30 is disposed opposite to an inner circumferential surface of the fixing belt 10. The heating section 30 includes a heater 31, a reinforcing member 33, a heater holding member 32, and at least one heat sensitive body 34, and at least one urging member 35. The heater 31 heats the fixing belt 10.

The reinforcing member 33 reinforces the heater holding member 32. The reinforcing member 33 is for example a slim and long metal stay. The reinforcing member 33 has a first end 33A and a second end 33B. The first end 33A and the second end 33B are opposite ends of the reinforcing member 33 in a longitudinal direction of the reinforcing member 33.

The heater holding member 32 holds the heater 31. The heater holding member 32 is disposed opposite to the fixing belt 10 with the heater 31 therebetween. The heater holding member 32 is for example made from a heat resistant resin. The heater holding member 32 extends in a direction parallel to the rotation axis L of the pressure member 20. The heater holding member 32 includes an engaging portion 32A. The engaging portion 32A engages with the first end 33A of the reinforcing member 33.

The reinforcing member 33 turns in a rotational direction R about the engaging portion 32A as a pivot. Note that FIG. 1 illustrates a state in which the fixing belt 10 is removed from the fixing device 1 and the reinforcing member 33 turns so that the second end 33B of the reinforcing member 33 moves away from the heater holding member 32. The reinforcing member 33 turns so that the second end 33B thereof moves toward the heater holding member 32, and is then secured to be located opposite to the heater holding member 32. In the following, a "state in which the reinforcing member 33 and the heater holding member 32 are opposite to each other" may be referred to as a "reinforcing member opposed state". The reinforcing member 33 extends in a direction parallel to the rotation axis L of the pressure member 20 in the reinforcing member opposed state.

The heat sensitive body 34 is disposed opposite to the heater 31. The heat sensitive body 34 is disposed on the heater holding member 32. For example, the heat sensitive body 34 is inserted at a central part thereof in terms of the longitudinal of the reinforcing member 33 into an opening of the heater holding member 32 so as to be adjacent to the heater 31. The heat sensitive body 34 senses heat of the heater 31. The heat sensitive body 34 detects a temperature of the heater 31 in the present embodiment.

The urging member 35 is disposed between the reinforcing member 33 and the heat sensitive body 34. The urging member 35 is for example a coil spring. The urging member 35 is for example in a cylindrical shape, a conical shape, or a barrel shape. The urging member 35 urges the heat sensitive body 34 against the heater 31 in the reinforcing member opposed state.

In the reinforcing member opposed state, a distance K2 between the heat sensitive body 34 and the second end 33B of the reinforcing member 33 is shorter than a distance K1 between the heat sensitive body 34 and the first end 33A of the reinforcing member 33. In other words, the central part of the heat sensitive body 34 in terms of the longitudinal direction of the reinforcing member 33 is disposed closer to the second end 33B than to the first end 33A in the reinforcing member opposed state. Arrangement of the heat sensitive body 34 on the heater holding member 32 as described above can reduce inclination of the reinforcing member 33 relative to a main surface of the heat sensitive body 34 located opposite to the reinforcing member 33 in assembling the reinforcing member 33 by turning the reinforcing member 33 to bring the reinforcing member 33 into contact with the urging member 35. Accordingly, the heat sensitive body 34 can be prevented from coming into contact with the heater 31 with inclination and pressed against the heater 31 in the reinforcing member opposed state. Thus, accuracy of sensitivity to heat of the heater 31 can be improved. Furthermore, buckling of the urging member 35 when the reinforcing member 33 turns to come in contact with the urging member 35 can be prevented. Note that the "distance K1 between the heat sensitive body 34 and the first end 33A of the reinforcing member 33" in the reinforcing member opposed state may be referred to as a "first distance K1". Also, the "distance K2 between the heat sensitive body 34 and the second end 33B of the reinforcing member 33" in the reinforcing member opposed state may be referred to as a "second distance K2".

Figure 2:
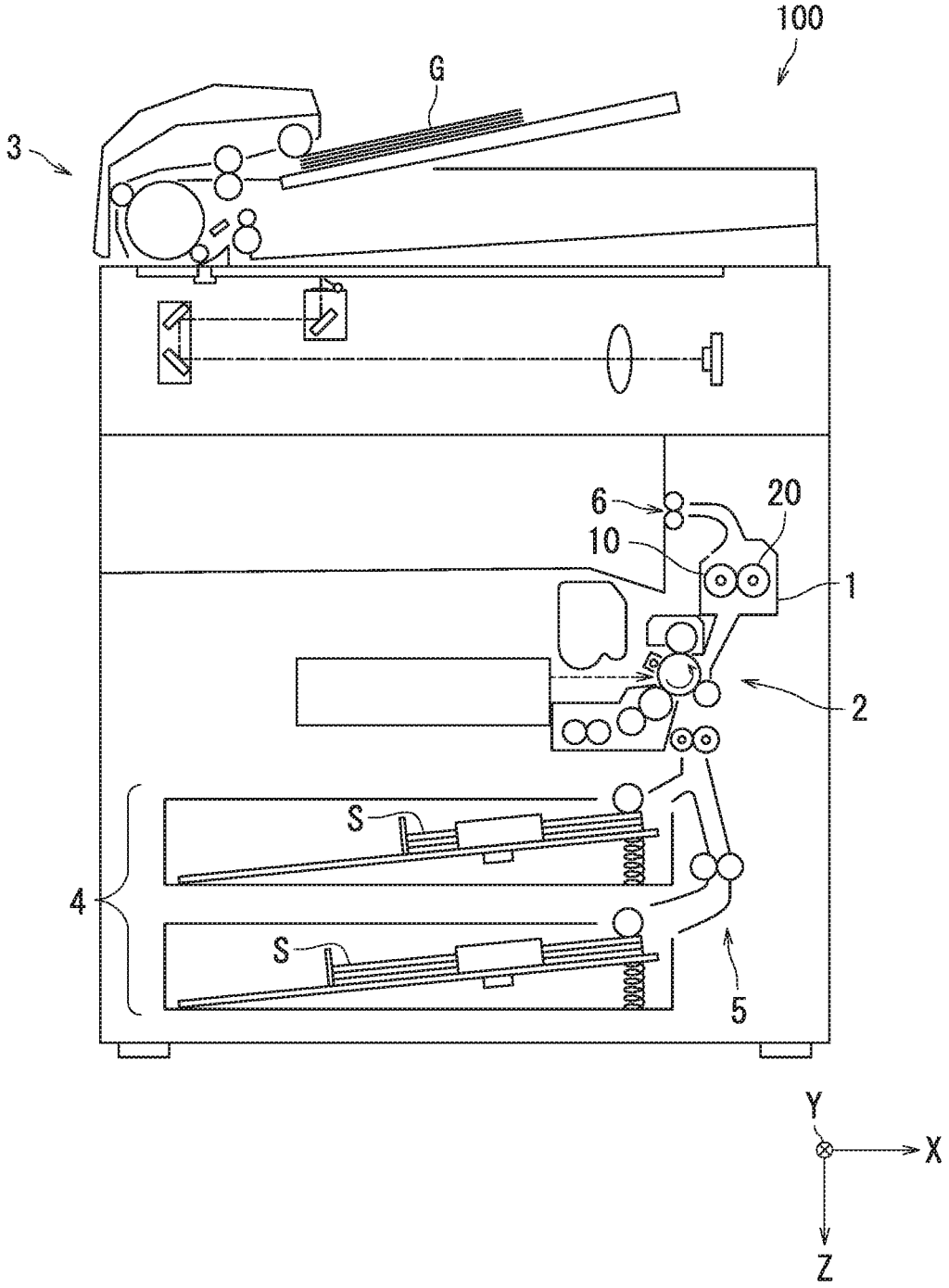
FIG. 2 is a diagram illustrating an image forming apparatus including the fixing device.

Operation and configuration of an image forming apparatus 100 including the fixing device 1 will be described next with reference to FIG. 2. FIG. 2 is a diagram illustrating the image forming apparatus 100. The image forming apparatus 100 is for example a copier, a printer, a facsimile machine, or a multifunction peripheral that implements functions of the aforementioned machines. The following describes an embodiment in which the image forming apparatus 100 is a monochrome multifunction peripheral.

As illustrated in FIG. 2, the image forming apparatus 100 includes a reading section 3, a feeding section 4, a conveyance section 5, an image forming section 2, the fixing device 1, and an ejection section 6.

The reading section 3 reads an image of a document G. The reading section 3 generates image data based on the read image. The feeding section 4 accommodates a plurality of sheets S and feeds the sheets S to the conveyance section 5 one at a time. Each of the sheets S is for example a sheet of paper or a sheet made from a synthetic resin. The conveyance section 5 includes a plurality of conveyance roller pairs and conveys the sheet S to the image forming section 2.

The image forming section 2 electrographically forms a toner image on the sheet S. Specifically, the image forming section 2 includes a photosensitive drum, a charger, a light exposure device, a development device, a replenishment device, a transfer device, a cleaner, and a static eliminator. The toner image represents for example the image of the document G. The fixing device 1 fixes the toner image to the sheet S by applying heat and pressure to the toner image. The conveyance section 5 conveys the sheet S with the toner image fixed thereto to the ejection section 6. The ejection section 6 ejects the sheet S out of the image forming apparatus 100.

Figure 3A:
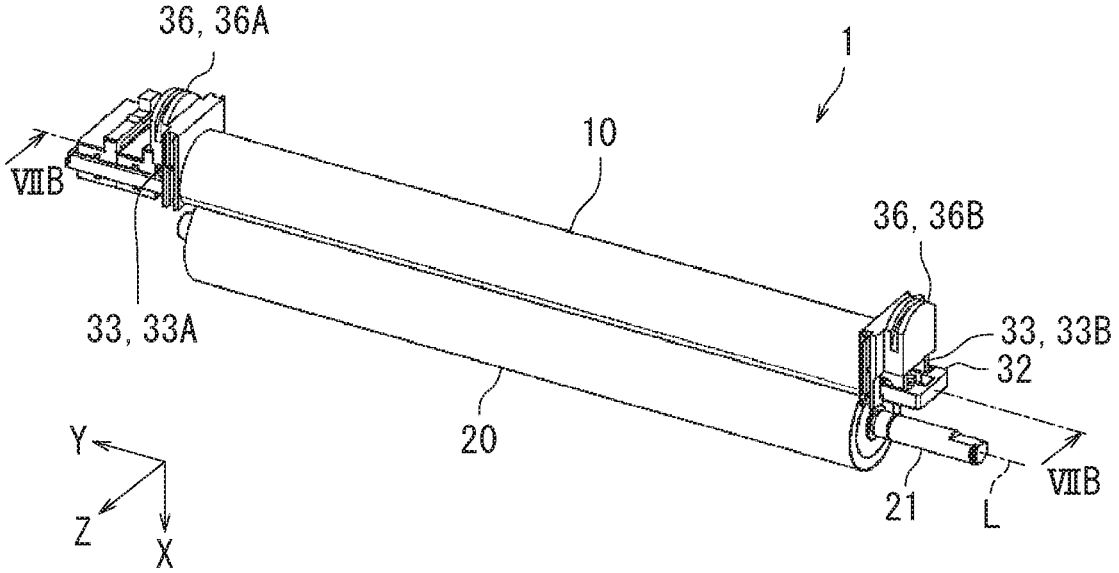
FIG. 3A is a perspective view of the fixing device.
Figure 3B:
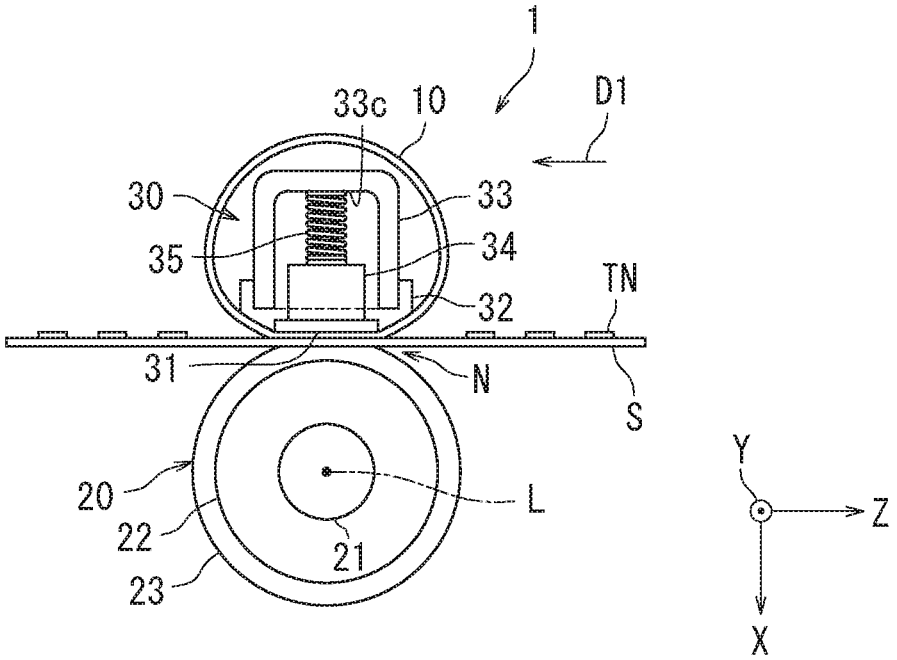
FIG. 3B is a diagram illustrating the fixing device.

A configuration of the fixing device 1 will be described next in detail with reference to FIGS. 3A and 3B. FIG. 3A is a perspective view of the fixing device 1. FIG. 3B is a diagram illustrating the fixing device 1. Note that FIG. 3B is simplified for the sake of easy viewing of the heating section 30.

As illustrated in FIG. 3A, the fixing device 1 includes a belt holding member 36 and an unillustrated drive mechanism in addition to the fixing belt 10, the pressure member 20, and the heating section 30 described with reference to FIG. 1.

The fixing belt 10 is a flexible endless belt in a substantial tubular shape. The fixing belt 10 includes a plurality of layers. The fixing belt 10 includes for example a polyimide layer and a release layer disposed on the polyimide layer. The release layer is for example a heat resistant film made from a fluororesin.

The belt holding member 36 holds opposite ends of the fixing belt 10 in a width direction of the fixing belt 10. Specifically, the belt holding member 36 includes a first belt holding portion 36A and a second belt holding portion 36B.

The first belt holding portion 36A holds an end of the fixing belt 10 that is located in correspondence with (close to) the first end 33A of the reinforcing member 33 in the reinforcing member opposed state. The second belt holding portion 36B holds an end of the fixing belt 10 that is located in correspondence with (close to) the second end 33B of the reinforcing member 33 in the reinforcing member opposed state.

Furthermore, the belt holding member 36 secures the reinforcing member 33 to the heater holding member 32 in the reinforcing member opposed state. Specifically, when the belt holding member 36 is fitted to the reinforcing member 33 in the reinforcing member opposed state, the first belt holding portion 36A and the second belt holding portion 36B respectively secure the first end 33A and the second end 33B of the reinforcing member 33 to the heater holding member 32.

As illustrated in FIGS. 3A and 3B, the pressure member 20 has a columnar shape. The pressure member 20 includes a columnar core bar 21, a cylindrical elastic layer 22, and a release layer 23. The elastic layer 22 is disposed around the core bar 21, and the release layer 23 covers a surface of the elastic layer 22. The core bar 21 is for example made from stainless or aluminum. The elastic layer 22 is elastic and is made from for example a silicone rubber. The release layer 23 is made from for example a fluororesin.

The pressure member 20 is pressed against the heater 31 with the fixing belt 10 therebetween, thereby being in pressure contact with the fixing belt 10. A nip part N is formed at a location where the pressure member 20 is in pressure contact with the fixing belt 10. When the pressure member 20 is driven and rotate, the fixing belt 10 follows the rotation of the pressure member 20 to be rotated. When the sheet S passes through the nip part N through conveyance of the sheet S in a sheet conveyance direction D1, the toner image TN is melted and fixed to the sheet S.

The drive mechanism drives and rotates the pressure member 20. The drive mechanism includes for example a drive motor and a gear. The drive mechanism is connected to one of opposite ends of the core bar 21 of the pressure member 20 in a longitudinal direction of the pressure member 20. The drive mechanism is disposed for example close to the second end 33B of the first and second ends 33A and 33B of the reinforcing member 33.

The heat sensitive body 34 illustrated in FIG. 3B includes at least one of a thermal fuse, a thermostat, and a thermistor. The thermal fuse is a protection element such as a one-shot thermostat. The thermal fuse shuts off electric power supply to the heater 31 when the temperature of the heater 31 is equal to or higher than a first threshold. In particular, once the thermal fuse shuts off the electric power supply according to the temperature of the heater 31, the electric power supply is not resumed. Therefore, accuracy in suspending heating of the fixing belt 10 by the heater 31 when the temperature of the heater 31 is excessively increased can be improved.

The thermostat shuts off the electric power supply to the heater 31 when the temperature of the heater 31 is equal to or higher than a second threshold and causes the electric power supply to the heater 31 to be resumed when the temperature of the heater 31 becomes lower than the second threshold. In the above configuration, the heater 31 for heating the fixing belt 10 can be turned on and off with delicate accuracy corresponding to temperature change of the heater 31.

The thermistor is a semiconductor element for measuring the temperature of the heater 31. The image forming apparatus 100 controls the heater 31 according to the temperature of the heater 31 measured by the thermistor. As a result of the heat sensitive body 34 being a thermistor, accuracy in controlling the temperature of the heater 31 can be improved. Note that the following embodiments describe a case in which the heat sensitive body 34 is a thermal fuse.

The reinforcing member 33 is substantially an inverted U-shape in cross section as viewed in a direction parallel to the rotation axis L. The reinforcing member 33 has a contact surface 33C that is in contact with the urging member 35. Preferably, the contact surface 33C is a plane surface. As a result of the contact surface 33C being a plane surface, a degree of close contact of the contact surface 33C with a tip end of the urging member 35 can be increased.

Figure 4A:
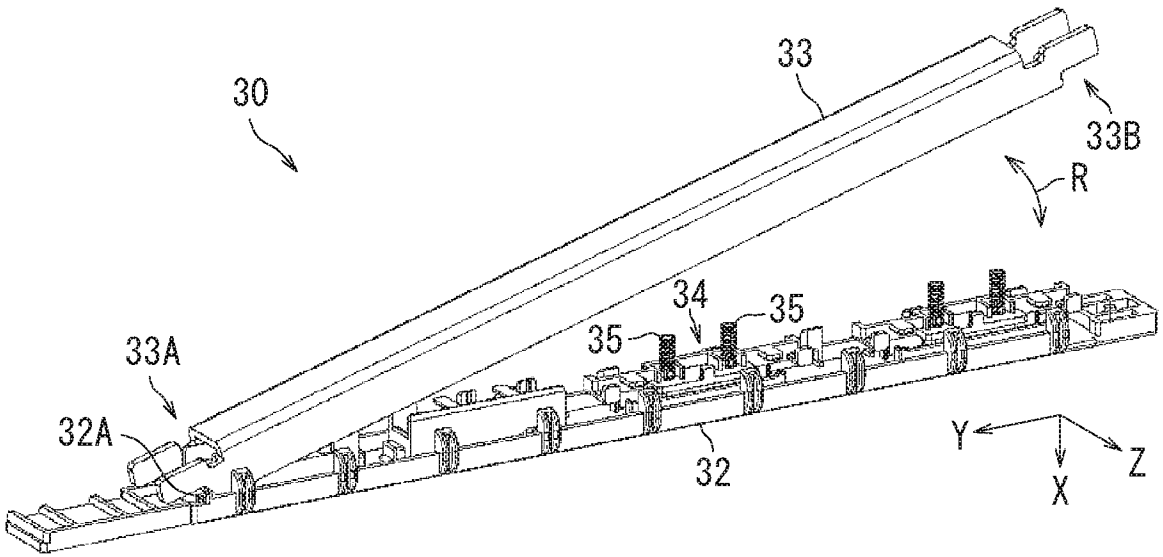
FIGS. 4A and 4B are perspective views of a heating section included in the fixing device.
Figure 4B:
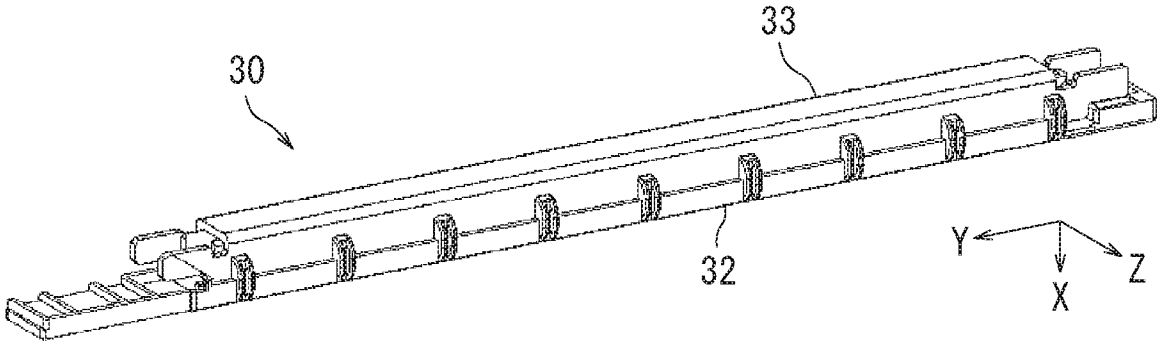

A configuration of the heating section 30 will be described next in detail with reference to FIGS. 4A to 5D. FIGS. 4A and 4B are perspective views of the heating section 30. FIG. 4A illustrates a state in which the second end 33B of the reinforcing member 33 is turned away from the heater holding member 32. The reinforcing member 33 turns about the engaging portion 32A as a pivot in the rotational direction R so that the second end 33B approaches the heater holding member 32 and then presses the urging member 35. The reinforcing member 33 is then laid over the heater holding member 32 in a longitudinal direction of the heater holding member 32 as illustrated in FIG. 4B to be located opposite to the heater holding member 32.

Figure 5A:
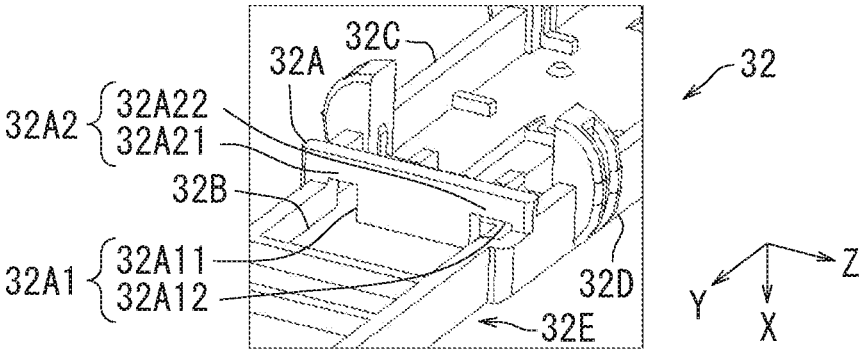
FIG. 5A is an enlarged partial view of a heater holding member of the heating section.
Figure 5B:
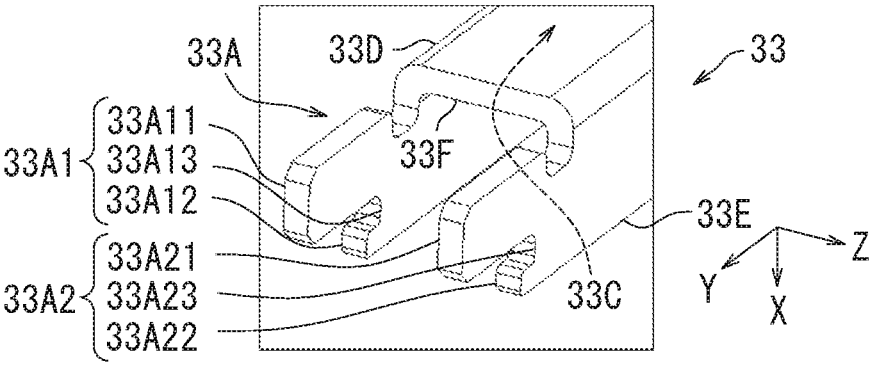
FIG. 5B is an enlarged partial view of a reinforcing member of the heating section.
Figure 5C:
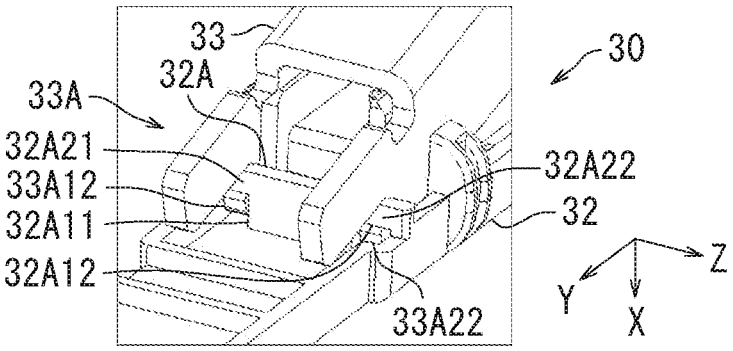
FIGS. 5C and 5D are enlarged partial views of the heating section.
Figure 5D:
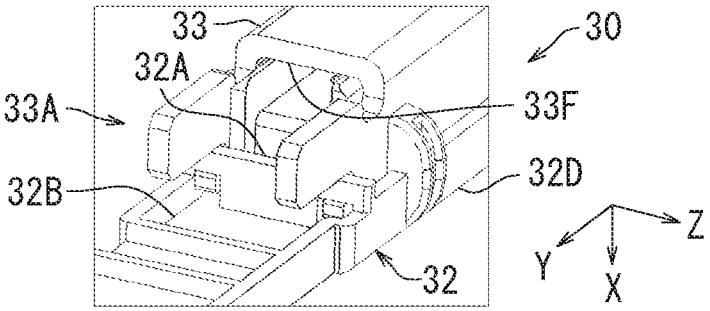

Engagement between the engaging portion 32A of the heater holding member 32 and the first end 33A of the reinforcing member 33 will be described in detail with reference to FIGS. 5A to 5D. FIG. 5A is an enlarged partial view of the heater holding member 32. FIG. 5B is an enlarged partial view of the reinforcing member 33. FIGS. 5C and 5D are perspective views of the heating section 30.

As illustrated in FIG. 5A, the heater holding member 32 includes a bottom wall 32B, a first side wall 32C, a second side wall 32D, and a connector receiving portion 32E. The first side wall 32C and the second side wall 32D each stand from the bottom wall 32B. The first side wall 32C is disposed opposite to the second side wall 32D with the bottom wall 32B therebetween. The connector receiving portion 32E is disposed close to one end of the opposite ends of the heater holding member 32 in the longitudinal direction of the heater holding member 32 that is for example closer to the engaging portion 32A than the other end thereof. The connector receiving portion 32E is capable of receiving a connector of a main body of the image forming apparatus 100.

The engaging portion 32A is disposed adjacent to the connector receiving portion 32E, for example. The engaging portion 32A stands from the bottom wall 32B and crosses at right angles with the first side wall 32C and the second side wall 32D. The engaging portion 32A is in a plate-like shape and has rotation pivot portions 32A2 and through holes 32A1. The rotation pivot portions 32A2 each extend in a direction perpendicular to the first side wall 32C and the second side wall 32D, and each serve as a rotation axis. The rotation pivot portions 32A2 include a first rotation pivot portion 32A21 and a second rotation pivot portion 32A22.

The through holes 32A1 have a first through hole 32A11 and a second through hole 32A12. The first through hole 32A11 is located close to the first side wall 32C between the bottom wall 32B and the first rotation pivot portion 32A21. The second through hole 32A12 is located close to the second side wall 32D between the bottom wall 32B and the second rotation pivot portion 32A22.

As illustrated in FIG. 5B, the reinforcing member 33 includes a first side plate 33D, a second side plate 33E, and a top plate 33F. The first and second side plates 33D and 33E each stand from the top plate 33F. The first side plate 33D is located opposite to the second side plate 33E with the top plate 33F therebetween. The contact surface 33C serves as a top surface of the top plate 33F.

The first end 33A of the reinforcing member 33 includes a first crotch 33A1 and a second crotch 33A2. The first crotch 33A1 is branched and is disposed at an end of the first side plate 33D. The first crotch 33A1 includes a first protrusion 33A11, a second protrusion 33A12, and a first recessed portion 33A13. The first protrusion 33A11 and the second protrusion 33A12 are located opposite to each other with the first recessed portion 33A13 therebetween, and protrude from the first side plate 33D in the longitudinal direction of the reinforcing member 33. The first protrusion 33A11 is longer than the second protrusion 33A12.

The second crotch 33A2 is branched and is disposed at an end of the second side plate 33E. The second crotch 33A2 includes a third protrusion 33A21, a fourth protrusion 33A22, and a second recessed portion 33A23. The third protrusion 33A21 and the fourth protrusion 33A22 are located opposite to each other with the second recessed portion 33A23 therebetween, and protrude from the second side plate 33E in the longitudinal direction of the reinforcing member 33. The third protrusion 33A21 is longer than the fourth protrusion 33A22.

As illustrated in FIG. 5C, the second protrusion 33A12 is inserted in the first through hole 32A11. The fourth protrusion 33A22 is inserted in the second through hole 32A12. The second protrusion 33A12 and the fourth protrusion 33A22 turn about the first rotation pivot portion 32A21 and the second rotation pivot portion 32A22 as pivots, respectively. As illustrated in FIG. 5D, the reinforcing member 33 and the heater holding member 32 are located opposite to each other. In the above configuration, inclination of the contact surface 33C of the reinforcing member 33 relative to the bottom wall 32B of the heater holding member 32 in the reinforcing member opposed state can be prevented. Thus, accuracy of sensitivity to heat of the heater 31 can be further improved.

Figure 6A:
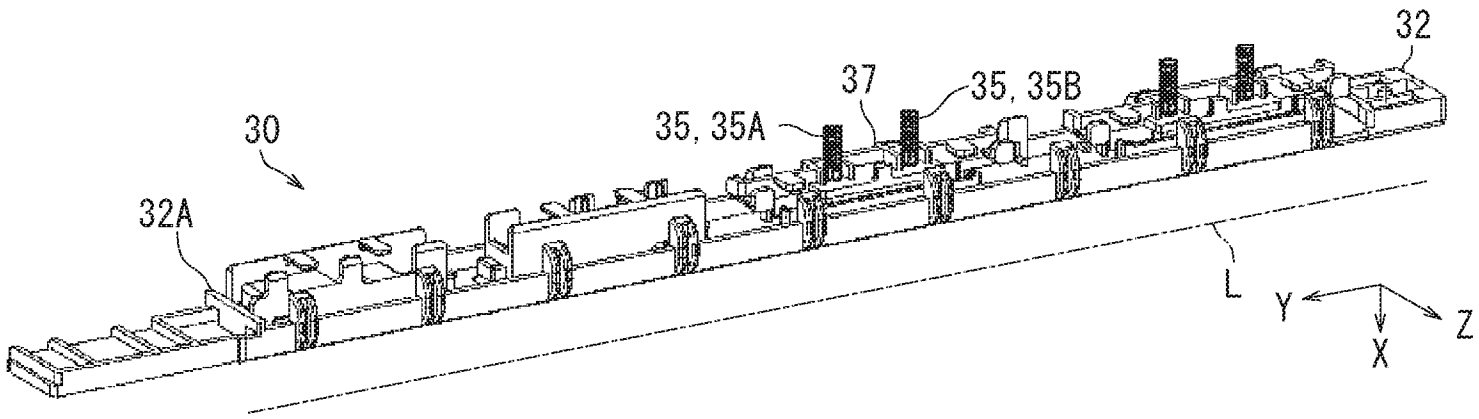
FIG. 6A is a perspective view of the heating section.

Detailed description of the configuration of the heating section 30 will continue with reference to FIGS. 6A to 9B. FIG. 6A is a perspective view of the heating section 30. FIG. 6B is an enlarged partial view of the heating section 30. As illustrated in FIG. 6A, the heating section 30 preferably includes at least one covering member 37. In a preferable embodiment, two urging members 35 are provided for each covering member 37.

Figure 6B:
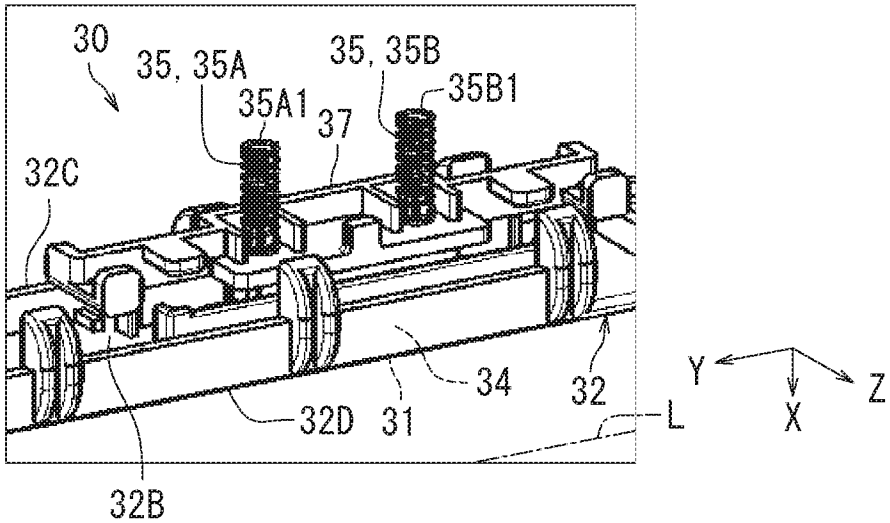
FIG. 6B is an enlarged partial view of the heating section.

As illustrated in FIG. 6B, the covering member 37 is disposed opposite to the heater holding member 32 with the heat sensitive body 34 therebetween. Specifically, the covering member 37 is overlaid with the heater 31, the heater holding member 32, and the heat sensitive body 34 in a direction intersecting with the rotation axis L. The covering member 37 has a shape corresponding to the shape of the heat sensitive body 34. The covering member 37 is for example a box-shaped member made from a resin and is heat resistant. The covering member 37 may include a plurality of arms that each hold a wire. The covering member 37 covers at least a part of the heat sensitive body 34 to separate the heat sensitive body 34 from the urging member 35.

The two urging members 35 are arranged in a direction parallel to the rotation axis L. In the following preferable embodiment, "one urging member 35 of the two urging members 35" may be referred to as a "first urging member 35A" while "the other urging member 35 of the two urging members 35" may be referred to as a second urging member 35B". The first urging member 35A is disposed closer to the engaging portion 32A than to the second urging member 35B. The two urging members 35 urge the heat sensitive body 34 through the covering member 37. That is, the first urging member 35A and the second urging member 35B urge, at respective two positions in a direction parallel to the rotation axis L, the heat sensitive body 34 extending in a direction parallel to the rotation axis L with the covering member 37 therebetween. In the above configuration, the urging members 35 can exert respective urging forces in balance on the heat sensitive body 34. Thus, accuracy in sensing the heat of the heater 31 can be further improved.

Furthermore, the two urging members 35 are preferably secured to the covering member 37. When the reinforcing member 33 turns, the reinforcing member 33 comes in contact with a tip end 35A1 of the first urging member 35A and a tip end 35B1 of the second urging member 35B. In the above configuration, displacement of the urging members 35 relative to the heat sensitive body 34 in turning of the reinforcing member 33 can be inhibited. Thus, accuracy in sensing the heat of the heater 31 can be improved and assembly of the heating section 30 can be facilitated.

Figure 7A:
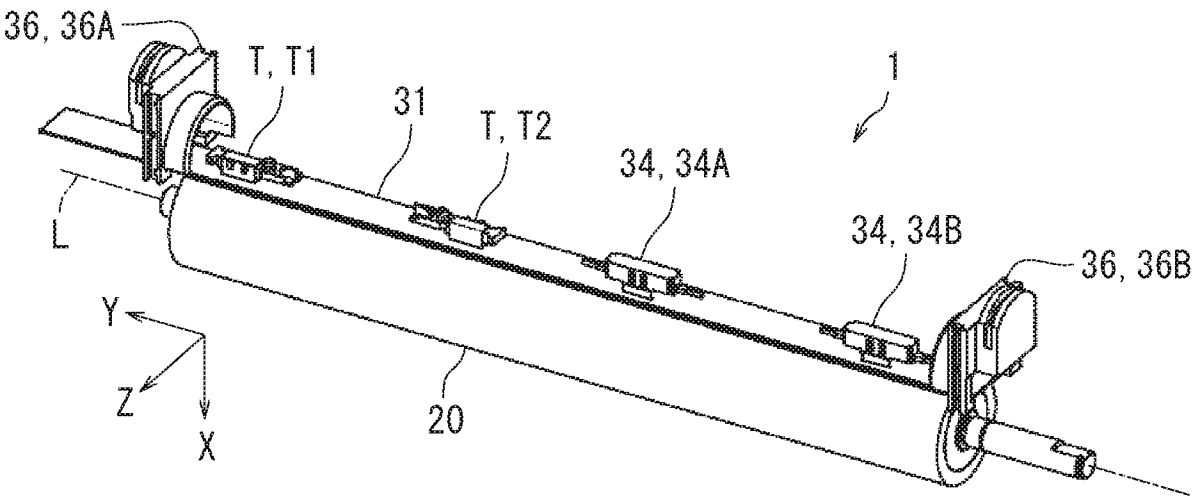
FIG. 7A is a perspective view of the fixing device.
Figure 7B:
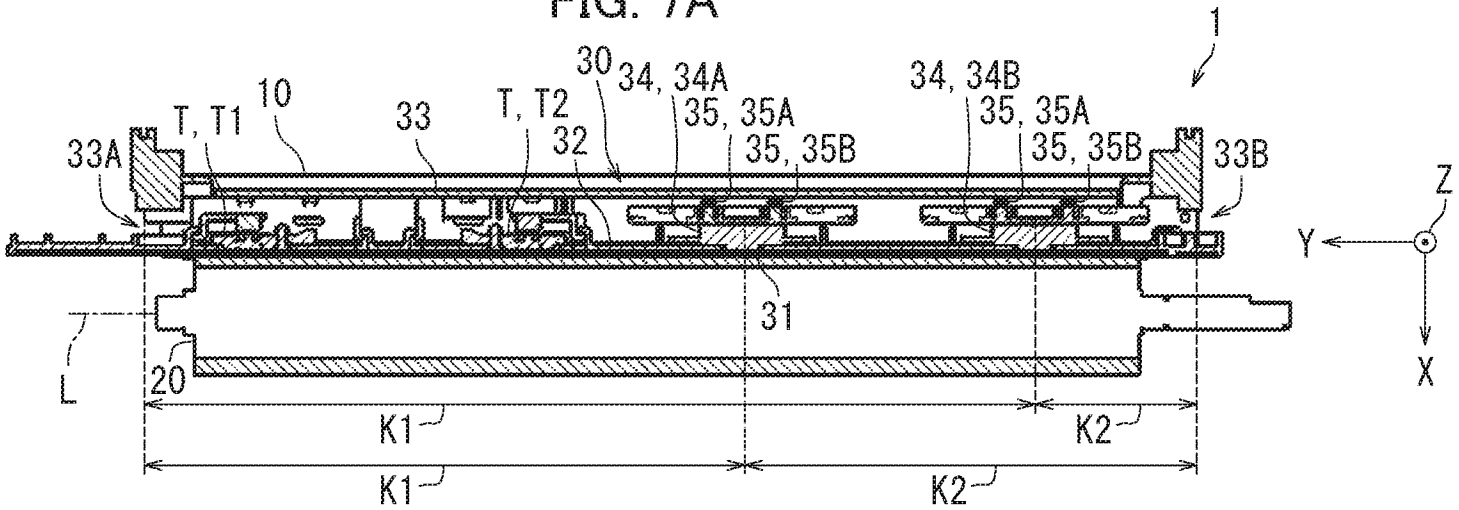
FIG. 7B is a cross-sectional view taken along a line VIIB-VIIB in FIG. 3A.

As illustrated in FIGS. 7A and 7B, the number of heat sensitive bodies 34 may be plural in a preferable embodiment. FIG. 7A is a perspective view of the fixing device 1. FIG. 7B is a cross-sectional view taken along a line VIIB-VIIB in FIG. 3A. The heat sensitive bodies 34 includes a first heat sensitive body 34A and a second heat sensitive body 34B. The first heat sensitive body 34A and the second heat sensitive body 34B are each a thermal fuse, for example. Note that a plurality of heat sensitive bodies T may be provided at positions closer to the first end 33A than to the second end 33B of the reinforcing member 33 on the heater 31 in addition to the heat sensitive bodies 34. The heat sensitive bodies T includes a third heat sensitive body T1 and a fourth heat sensitive body T2, for example. The third heat sensitive body T1 and the fourth heat sensitive body T2 are each a thermistor, for example.

The heater 31 is planer in shape or in a slender thin plate-like shape. The heater 31 extends in a direction parallel to the rotation axis L of the pressure member 20. The heater 31 is for example a ceramic heater and includes a ceramic substrate and a resistance heating element. The heater 31 has a thickness of 1 mm, for example.

As illustrated in FIG. 7B, the number of urging members 35 may be plural in a preferable embodiment. In the preferable embodiment, sets of urging members 35 are each provided for a corresponding one of the heat sensitive bodies 34. The urging members 35 include for example two sets of "two urging members 35 (a first urging member 35A and a second urging member 35B)".

The heat sensitive bodies 34 are arranged in a longitudinal direction of the heater 31 so as to be closer to the second end 33B than to the first end 33A of the reinforcing member 33 in the reinforcing member opposed state. That is, the second distance K2 is shorter than the first distance K1 for each of the heat sensitive bodies 34. The urging members 35 each urge a corresponding one of the heat sensitive bodies 34 against the heater 31 in the reinforcing member opposed state. Accordingly, the heat sensitive bodies 34 can be prevented from coming into contact with the heater 31 with inclination and pressed against the heater 31 in the reinforcing member opposed state. Thus, accuracy of sensitivity to heat of the heater 31 can be improved.

Note that in a case where a plurality of thermal fuses and a plurality of thermistors are disposed on the heater 31, the thermal fuses and the thermistors are preferably provided as the heat sensitive bodies 34 and the heat sensitive bodies T, respectively. Arrangement of the thermal fuses and the thermistors such as above allows the second distance K2 to be shorter than the first distance K1 for each of the thermal fuses rather than for each of the thermistors. Accordingly, a situation in which heating of the fixing belt 10 by the heater 31 is erroneously continued in an excessive increase in temperature of the heater 31 can be prevented.

Figure 8A:
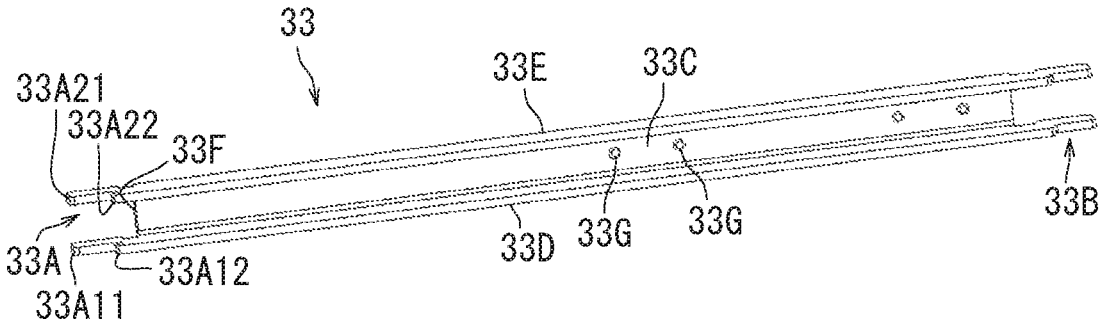
FIG. 8A is a perspective view of the reinforcing member.
Figure 8B:
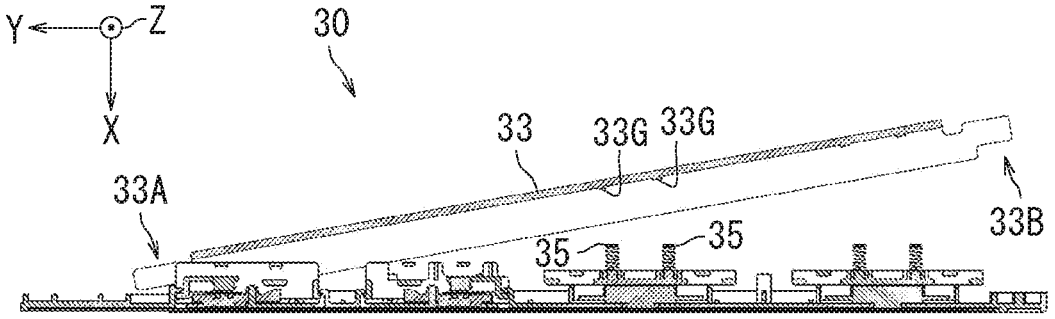
FIG. 8B is a cross-sectional view of the heating section.
Figure 8C:
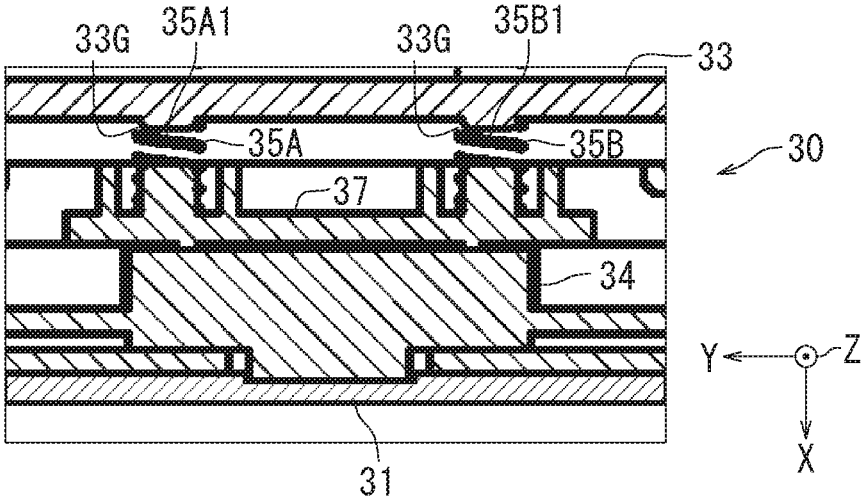
FIG. 8C is an enlarged partial view of the heating section.

Furthermore, the reinforcing member 33 preferably includes protrusions 33G as illustrated in FIGS. 8A to 8C. FIG. 8A is a perspective view of the reinforcing member 33. FIG. 8B is across-sectional view of the heating section 30. FIG. 8C is an enlarged partial view of the heating section 30. The protrusions 33G protrude from the contact surface 33C of the reinforcing member 33 toward the urging members 35.

As illustrated in FIG. 8B, the protrusions 33G are located on the contact surface 33C in correspondence with the location of the urging members 35. For example, two protrusions 33G are provided in correspondence with the two urging members 35.

As illustrated in FIG. 8C, the protrusions 33G are fitted in the respective urging members 35, which are coil springs, in the reinforcing member opposed state. Specifically, the protrusions 33G each have a shape corresponding to the inner diameter of the coil springs. When the reinforcing member 33 turns, the respective two protrusions 33G come in contact with and are fitted in the tip end 35A1 of the first urging member 35A and the tip end 35B1 of the second urging member 35B. In the above configuration, posture stability of the urging members 35 can be increased in turning of the reinforcing member 33. Thus, displacement of the urging members 35 relative to the corresponding heat sensitive body 34 can be further inhabited.

Figure 9A:
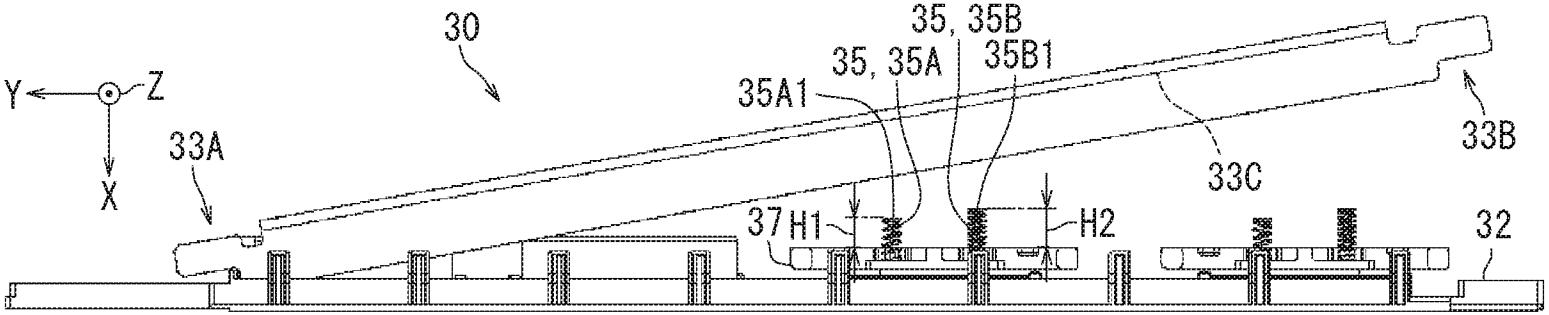
FIG. 9A is a side view of the heating section.
Figure 9B:
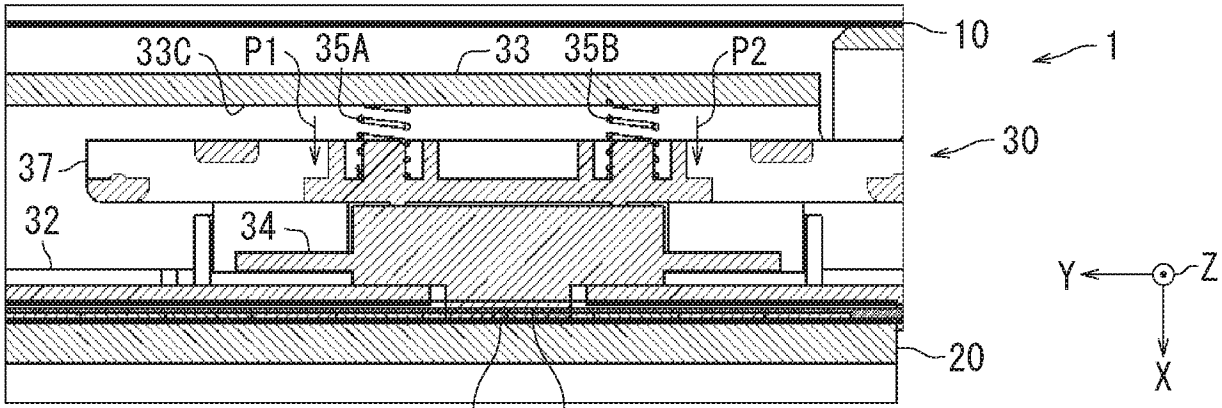
FIG. 9B is an enlarged partial view of the fixing device.

Furthermore, a free length H1 of the first urging member 35A is preferably shorter than a free length H2 of the second urging member 35B as illustrated in FIGS. 9A and 9B. FIG. 9A is a side view of the heating section 30. FIG. 9B is an enlarged partial view of the fixing device 1. A free length refers to an entire length of an urging member under no load as illustrated in FIG. 9A. Specifically, the free lengths H1 and H2 of the first and second urging members 35A and 35B are entire lengths of the first and second urging members 35A and 35B, respectively, in a state in which the corresponding heat sensitive body 34 is not urged.

As illustrated in FIGS. 9A and 9B, a distance between the first urging member 35A and the first end 33A of the reinforcing member 33 is shorter than a distance between the second urging member 35B and the first end 33A in a state in which the reinforcing member 33 is in contact with the first urging member 35A and the second urging member 35B. In the above configuration, difference in timing between when the contact surface 33C of the reinforcing member 33 reaches the tip end 35A1 of the first urging member 35A and when the contact surface 33C thereof reaches the tip end 35B1 of the second urging member 35B in turning of the reinforcing member 33 can be reduced. Furthermore, inclination of the corresponding heat sensitive body 34 when the contact surface 33C of the reinforcing member 33 comes in contact with the two urging members 35 can be prevented. Buckling of the first urging member 35A can also be prevented. Thus, assembly of the heating section 30 can be further facilitated.

It is preferable that the urging force of the first urging member 35A urging the corresponding heat sensitive body 34 is equal to the urging force of the second urging member 35B urging the corresponding heat sensitive body 34 in the reinforcing member opposed state. Specifically, a pressure P1 by the urging force of the first urging member 35A is preferably equal to a pressure P2 by the urging force of the second urging member 35B in a state in which the first and second urging members 35A and 35B urge the corresponding heat sensitive body 34 against the heater 31. In other words, specifications of the first and second urging members 35A and 35B are preset so that the pressure P1 by the urging force of the first urging member 35A and the pressure P2 by the urging force of the second urging member 35B are equal to each other in the reinforcing member opposed state. The specifications include for example a coil diameter, inner diameter, and spring constant of the coil springs. In the above configuration, close contact between the heater 31 and a surface 34C of each heat sensitive body 34 facing the heater 31 can be increased in the reinforcing member opposed state. Thus, accuracy in sensing the heat of the heater 31 can be further improved.

Embodiments of the present disclosure have been described so far with reference to the accompanying drawings. However, the present disclosure is not limited to the above-described embodiments and can be practiced in various ways within the scope without departing from the essence of the present disclosure. Elements of configuration disclosed in the above embodiments can be combined as appropriate in various different forms. For example, some of the elements of configuration may be omitted among all of the elements of configuration described in the embodiment. Alternatively or additionally, elements of configuration described in different embodiments may be combined as appropriate. The drawings are schematic illustrations that emphasize elements of configuration in order to facilitate understanding thereof, and the thickness, length, numbers, distance, and so on of each element of configuration illustrated in the drawings may differ from actual ones thereof in order to facilitate preparation of the drawings. The materials, shape, dimension, and so on of each element of configuration shown in the above-described embodiments are merely examples that do not impart any particular limitations and may be altered in various ways, so long as such alterations do not substantially deviate from the configuration of the present disclosure.

As described with reference to FIG. 2, the image forming apparatus 100 is a monochrome multifunction peripheral in the embodiments, which should not be taken to limit the present disclosure. The image forming apparatus 100 only need to be an electrographic image forming apparatus. For example, the image forming apparatus 100 may be a color multifunction peripheral.

What is claimed is:

1. A fixing device comprising:

a fixing belt;

a pressure member configured to apply pressure to the fixing belt while in contact with an outer circumferential surface of the fixing belt and rotate about a rotation axis of the pressure member; and a heating section disposed opposite to an inner circumferential surface of the fixing belt, wherein the heating section includes:

a heater that heats the fixing belt;

a heater holding member that holds the heater;

a reinforcing member that extends in a direction parallel to the rotation axis of the pressure member and that reinforces the heater holding member;

a heat sensitive body disposed on the heater holding member so as to be located opposite to the heater; and an urging member disposed between the reinforcing member and the heat sensitive body, the reinforcing member has a first end and a second end that are two opposite ends in a longitudinal direction of the reinforcing member, the heater holding member includes an engaging portion that engages with the first end of the reinforcing member, the reinforcing member turns about the engaging portion as a pivot to be located opposite to the heater holding member, the urging member urges the heat sensitive body against the heater in a state in which the reinforcing member is located opposite to the heater holding member, and in the state in which the reinforcing member is located opposite to the heater holding member, a distance between the heat sensitive body and the second end of the reinforcing member is shorter than a distance between the heat sensitive body and the first end of the reinforcing member.

2. The fixing device according to claim 1, comprising as the urging member, two urging members, wherein the heating section includes a covering member located opposite to the heater holding member with the heat sensitive body therebetween, the two urging members are provided for the covering member, and the two urging members are arranged in the direction parallel to the rotation axis of the pressure member and urge the heat sensitive body through the covering member.

3. The fixing device according to claim 2, wherein the two urging members are secured to the covering member.

4. The fixing device according to claim 1, wherein the reinforcing member includes a protrusion, the urging member is a coil spring, and the protrusion is fitted in the coil spring in the state in which the reinforcing member is located opposite to the heater holding member.

5. The fixing device according to claim 2, wherein the two urging members include a first urging member and a second urging member, the two urging members each are a coil spring, a distance between the first urging member and the first end of the reinforcing member is shorter than a distance between the second urging member and the first end of the reinforcing member, and the first urging member has a shorter free length than the second urging member.

6. The fixing device according to claim 5, wherein in the state in which the reinforcing member is located opposite to the heater holding member, an urging force of the first urging member urging the heat sensitive body is equal to an urging force of the second urging member urging the heat sensitive body.

7. The fixing device according to claim 1, wherein the reinforcing member has a contact surface that is in contact with the urging member, and the contact surface is planer in shape.

8. The fixing device according to claim 1, wherein the heat sensitive body includes at least one of a thermal fuse, a thermostat, and a thermistor, the thermal fuse shuts off electric power supply to the heater when a temperature of the heater is equal to or higher than a first threshold, the thermostat shuts off the electric power supply to the heater when the temperature of the heater is equal to or higher than a second threshold, and causes the electric power supply to the heater to be resumed when the temperature of the heater becomes lower than the second threshold, and the thermistor measures the temperature of the heater.

9. The fixing device according to claim 1, comprising:

as the heat sensitive body, a plurality of heat sensitive bodies; and as the urging member, a plurality of urging members, wherein the heater is a planer in shape and extends in the direction parallel to the rotation axis of the pressure member, the urging members are each provided for a corresponding one of the heat sensitive bodies, the heat sensitive bodies are arranged in a longitudinal direction of the heater so as to be closer to the second end of the reinforcing member than to the first end of the reinforcing member in the state in which the reinforcing member is located opposite to the heater holding member, and the urging members each urge a corresponding one of the heat sensitive bodies against the heater.

10. An image forming apparatus comprising:

the fixing device according to claim 1; and an image forming section configured to form a toner image on a sheet, wherein the fixing device fixes the toner image to the sheet.

* * * * *